US005359316A

United States Patent [19]

Ozawa et al.

[11] Patent Number: 5,359,316

[45] Date of Patent: Oct. 25, 1994

[54] ZINC OXIDE TYPE ARRESTER

[75] Inventors: Jun Ozawa, Hitachi; Kazuya Ooishi, Toukai; Katsuji Shindo, Hitachi, all of Japan

[73] Assignee: Hitachi Ltd., Tokyo, Japan

[21] Appl. No.: 18,501

[22] Filed: Feb. 17, 1993

[30] Foreign Application Priority Data

Feb. 24, 1992 [JP] Japan ..... 4-36511

[51] Int. Cl.[5] ..... H01C 7/10

[52] U.S. Cl. ..... 338/21; 338/235; 361/127

[58] Field of Search ..... 338/20, 21, 235; 361/127, 117

[56] References Cited

U.S. PATENT DOCUMENTS 5,241,294 8/1993 Pham et al. ..... 338/21

*Primary Examiner*—Marvin M. Lateef

*Attorney, Agent, or Firm*—Antonelli, Terry, Stout & Kraus

[57] ABSTRACT

A zinc oxide type arrester including: four constitutional units electrically connected in parallel and a closed container accommodating the constitutional units. Each of the constitutional units includes a first columnar stack body composed by stacking zinc oxide elements and insulating spacers in a first predetermined order, a second columnar stack body composed by stacking zinc oxide elements and insulating spacers in a second predetermined order and a third columnar stack body composed by stacking zinc oxide elements and insulating spacers in a third predetermined order, the zinc oxide elements in the first, second and third columnar stack bodies contained in one constitutional unit are connected in series as a whole, and at least two of the three columnar stack bodies having same stacking structures in adjoining constitutional units are arranged to closely face each other.

8 Claims, 4 Drawing Sheets

ZINC OXIDE TYPE ARRESTER

BACKGROUND OF THE INVENTION

1. Field of the Invention

The present invention relates to a zinc oxide type arrester and, in particular, relates to a zinc oxide type arrester having a plurality of constitutional units each of which is composed of a plurality of columnar stack bodies.

2. Description of Related Art

A conventional zinc oxide type arrester having the above structure is disclosed in JP-A-56-164502(1981) which is illustrated in FIG. 8. In the conventional zinc oxide type arrester, four constitutional units 100, 200, 300 and 400 are disposed within a closed container 50 in which SF6 gas is filled and each of the constitutional units is constituted by four columnar stack bodies a, b, c and d, and each of which is formed by stacking zinc oxide elements and insulating spacers. The respective columnar stack bodies a, b, c and d in the respective constitutional units are positioned at respective apexes of imaginary quadrangles and are electrically connected via bridge conductors 4 in such a manner that the columnar stack bodies a, b, c and d are wound in an order of a, b, c and d. The order of winding is identical in the respective constitutional units 100, 200, 300 and 400, however the respective constitutional units are arranged by rotating their respective columnar stack bodies a, b, c and d in their juxtaposed direction so that the columnar stack body b in the constitutional unit 100 adjoins with the columnar stack body b in the constitutional unit 200, the columnar stack body a in the constitutional unit 200 with the columnar stack body a in the constitutional unit 300, the columnar stack body d in the constitutional unit 300 with the columnar stack body d in the constitutional unit 400 and the columnar stack body c in the constitutional unit 400 with the columnar stack body c in the constitutional unit 100.

In the above arrangement of the respective constitutional units, the columnar stack bodies having the same stacking structure of the zinc oxide elements and the insulating spacers are arranged so as to face each other, such that the potentials along the stacking direction, namely the height direction, of the facing columnar stack bodies in the neighboring constitutional units are substantially the same, therefore the facing columnar stack bodies can be arranged closely each other to thereby reduce their insulating distance.

However, in the conventional zinc oxide type arrester explained above, the constitutional units 100, 200, 300 and 400 having an identical structure are employed and are disposed in the closed container 50 while merely rotating the same in the juxtaposed direction of their columnar stack bodies a, b, c and d depending upon their locations in the manner as explained above, therefore, the diameter of the closed container 50 which accommodates the entire constitutional units is caused to be increased. Namely, totally eight columnar stack bodies facing to a center of the closed container 50, the columnar stack bodies c and b for the constitutional unit 100, b and a for the constitutional unit 200, a and d for the constitutional unit 300, and d and c for the constitutional unit 400 are disposed on a substantially same imaginary circle, therefore the large space at the center of the closed container 50 is remained unused which causes to increase the diameter of the closed container 50 accordingly.

SUMMARY OF THE INVENTION

An object of the present invention is to provide a zinc oxide type arrester with a closed container having a reduced diameter accommodating a plurality of constitutional units including a plurality of columnar stack bodies.

For achieving the above object, a plurality of constitutional units are disposed in a closed container in such a manner that a plurality of columnar stack bodies in a constitutional unit are arranged so as to face to a plurality of columnar stack bodies in an adjoining constitutional unit and the respective facing columnar stack bodies are so constituted that potentials along their stacking direction are determined substantially the same.

In contrast to the conventional zinc oxide type arrester wherein one columnar stack body in a constitutional unit faces to one columnar stack body in an adjoining constitutional unit, in the zinc oxide type arrester according to the present invention as explained above the respective constitutional units are disposed in such a manner that a plurality of columnar stack bodies in a constitutional unit are arranged so as to face to a plurality of columnar stack bodies in an adjoining constitutional unit, therefore the number of columnar stack bodies in the respective constitutional units which are arranged close to a center of the closed container is reduced in comparison with that in the conventional structure and the columnar stack bodies of the reduced number are arranged around an imaginary circle of a small diameter, thereby the center of the closed container is also used advantageously and the diameter of the closed container is effectively reduced.

DESCRIPTION OF THE PREFERRED EMBODIMENTS

Hereinbelow, embodiments according to the present invention are explained with reference to the drawings.

Figure 1:
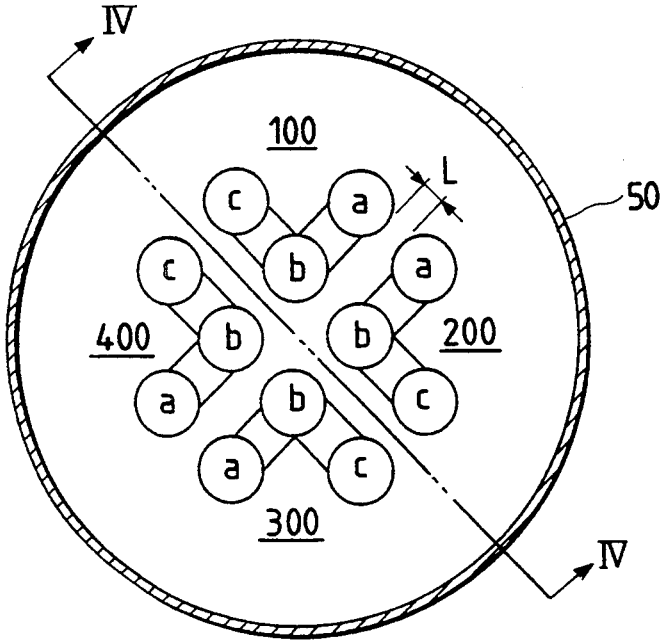
FIG. 1 is a horizontal cross sectional view of one embodiment of the zinc oxide type arresters according to the present invention.

FIG. 1 is a horizontal cross sectional view of one embodiment of the zinc oxide type arresters according to the present invention. Four constitutional units 100, 200, 300 and 400 are disposed inside a closed container 50 which is filled with SF6 gas, and each of the constitutional units is composed of three columnar stack bodies a, b and c each formed by stacking zinc oxide elements and insulating spacers which will be explained later in more detail. The respective columnar stack bodies a, b and c in the respective constitutional units are positioned at respective apexes of imaginary triangles and the columnar stack bodies a and b for the constitutional unit 100 are respectively arranged so as to face to the columnar stack bodies a and b for the constitutional unit 200 in an adjoining relationship, the columnar stack bodies b and c for the constitutional unit 200 to the columnar stack bodies b and c for the constitutional unit 300, the columnar stack bodies a and b for the constitutional unit 300 to the columnar stack bodies a and b for the constitutional unit 400 and the columnar stack bodies b and c for the constitutional unit 400 to the columnar stack bodies b and c for the constitutional unit 100, and further around an imaginary circle surrounding a center of the closed container 50 four columnar stack bodies b for the respective constitutional units 100, 200, 300 and 400 are arranged.

Figure 2:
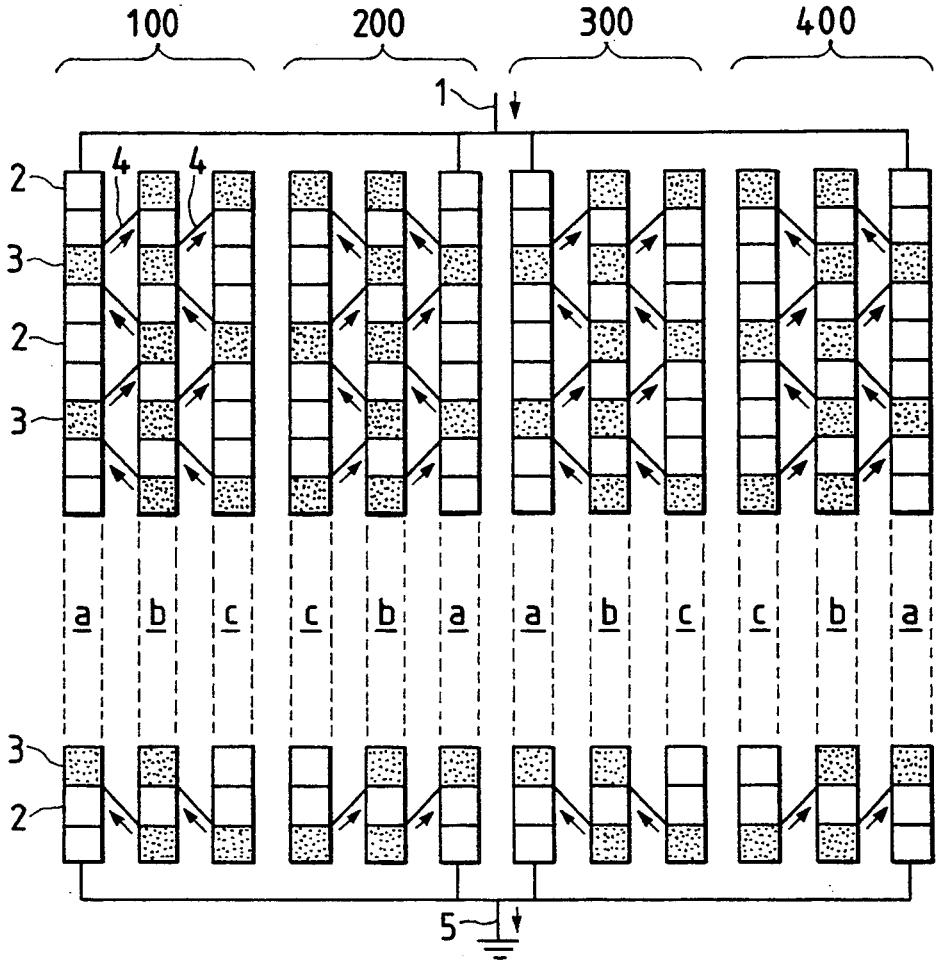
FIG. 2 is a development illustrating constitution of the respective constitutional units of the zinc oxide type arrester shown in FIG. 1.

Now, the constitution of the respective columnar stack bodies for the respective constitutional units is explained by making use of the development shown in FIG. 2.

The constitutional unit 100 is composed of three columnar stack bodies a, b and c, and the respective columnar stack bodies a, b and c are formed by stacking zinc oxide elements 2 and insulating spacers 3 and further the respective zinc oxide elements 2 in the respective columnar stack bodies a, b and c are electrically connected in series via bridge conductors 4. The constitution of the constitutional unit 200 is fundamentally the same as that of the constitutional unit 100, however as illustrated in FIG. 1, in order that the columnar stack bodies a and b for the constitutional unit 200 face the columnar stack bodies a and b for the constitutional unit 100, the columnar stack bodies thereof are arranged in an order of c, b and a in clockwise direction. Further, the constitution of the constitutional unit 300 is fundamentally the same as that of the constitutional unit 100, however as illustrated in FIG. 1, in order that the columnar stack bodies b and c for the constitutional unit 300 face the columnar stack bodies b and c for the constitutional unit 200, the columnar stack bodies thereof are arranged in an order of a, b and c in clockwise direction. Still further, the constitution of the constitutional unit 400 is fundamentally the same as that of the constitutional unit 100, however as illustrated in FIG. 1, in order that the columnar stack bodies a and b for the constitutional unit 400 face the columnar stack bodies a and b for the constitutional unit 300, the columnar stack bodies thereof are arranged in an order of c, b and a in clockwise direction. Since these respective constitutional units are arranged around the center of the closed container in an order of 100, 200, 300 and 400, the columnar stack bodies b and c for the constitutional unit 100 face the columnar stack bodies b and c for the constitutional unit 400. The respective lower end portions of the respective columnar stack bodies a for the four constitutional units 100, 200, 300 and 400 are connected to a common terminal 5 which is connected to the ground, on the other hand, the respective upper end portions of the four columnar stack bodies a are connected to a common terminal 1 which is connected to a high voltage terminal (not shown) for a gas insulated switch gear device. As will be seen from the drawing, the columnar stack bodies for the respective constitutional units denoted by the same reference symbols have identical constitutions, and the columnar stack bodies having the same constitutions are arranged so as to face each other, potentials of the facing columnar stack bodies along their stacking direction are substantially the same, accordingly there arises no problems with regard to insulation even when the facing columnar stack bodies are arranged much closer.

Figure 3:
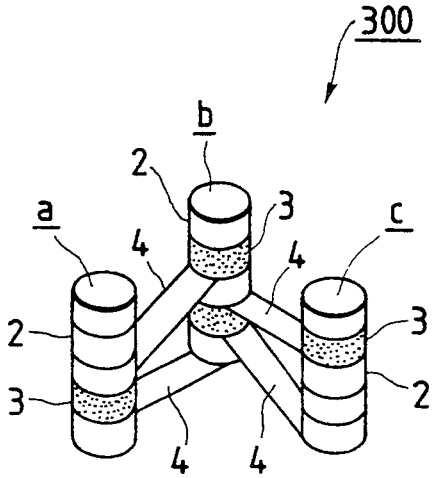
FIG. 3 is a perspective view of a major portion of the zinc oxide type arrester shown in FIG. 1.

Now, the constitution of the respective constitutional units 100, 200, 300 and 400 is explained more specifically. As explained above, the constitution of the constitutional unit 300 is identical with that of the constitutional unit 100, and the constitution of the constitutional unit 400 is identical with that of the constitutional unit 200. Therefore, as a representative of the four constitutional units, the constitution of the constitutional unit 300 is explained by making use the perspective view of its major portion as shown in FIG. 3.

The respective columnar stack bodies a, b and c are respectively composed of the zinc oxide elements 2 and the insulating spacers 3, and in order to connect the zinc oxide elements 2 in the respective columnar stack bodies in series, thin bridge conductors 4 having wide width are used which directly extend between the corresponding zinc oxide elements 2 of the facing columnar stack bodies. Further, for example, the zinc oxide elements 2 for the columnar stack body b are adapted to be connected alternatively to the zinc oxide elements 2 for the columnar stack body a and the zinc oxide elements 2 for the columnar stack body c and no zinc oxide elements 2 for the columnar stack body a are connected directly to the zinc oxide elements 2 for the columnar stack body c via the bridge conductors 4. Accordingly, in the respective columnar stack bodies a, b and c in the constitutional unit 300, through the series connection of the respective zinc oxide elements 2 the inductance component of the constitutional unit is minimized, namely the residual inductance thereof is reduced in comparison with an instance wherein the zinc oxide elements are connected in a spiral route, therefore a response characteristic to a steep impulse wave which is required for an arrester is improved. The above fundamental constitution is also applied to those for the constitutional units 100, 200 and 400.

Figure 4:
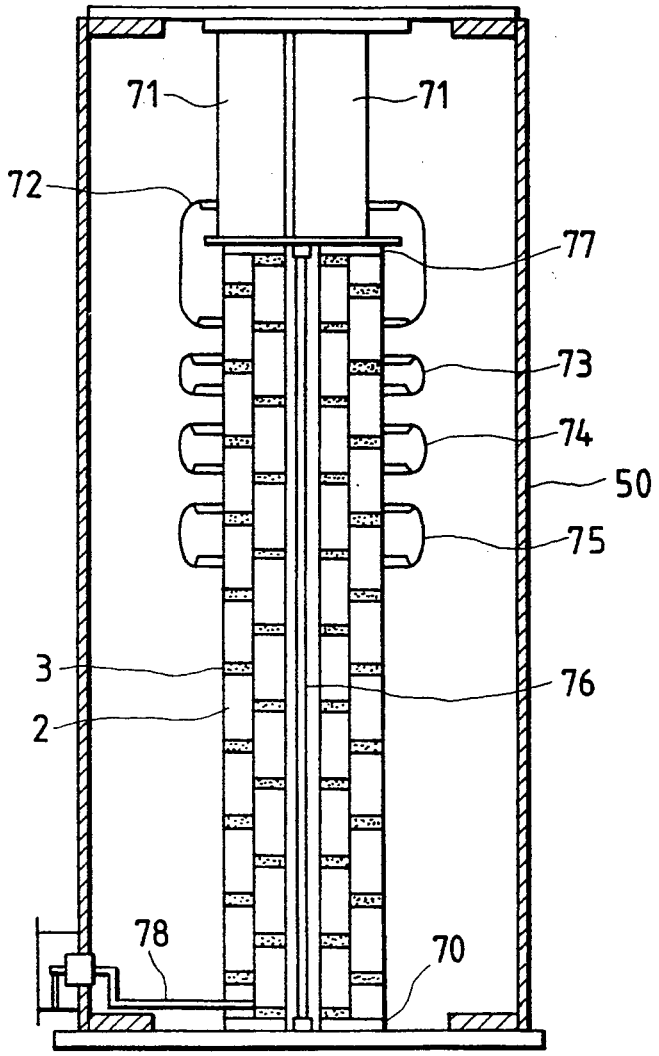
FIG. 4 is a vertical cross sectional view of the zinc oxide type arrester shown in FIG. 1.

FIG. 4 is a vertical cross sectional view of the zinc oxide type arrester taken along the line IV–IV in FIG. 1.

The constitutional units 100, 200, 300 and 400 each including a plurality of the columnar stack bodies are disposed as illustrated in FIG. 1. The lower ends of the respective constitutional units are secured to a bottom plate of the closed container 50 via an insulating plate 70. The upper ends thereof are altogether secured to a common high voltage terminal plate 77. Further, an insulating rod 76 is provided substantially at the center of the closed container 50 and the lower end of the insulating rod 76 is secured to the bottom plate of the closed container 50 and the upper end thereof is secured to the common high voltage terminal plate 77 to thereby support the respective columnar stack bodies. Still further, the common high voltage terminal plate 77 is secured to the lower ends of insulating cylinders 71 of which upper end portions are secured to the closed container 50. Moreover, multi-rings 72, 73, 74 and 75 for improving voltage division are coupled electrically and mechanically to the common high voltage terminal plate 77 and surround the respective constitutional units 100, 200, 300 and 400 thereby to further uniformalize potential division of the respective columnar stack bodies along their height direction. The lower electrical ends of the constitutional units 100, 200, 300 and 400 are led out from the closed container 50 via a conductor 78 while being electrically insulated from the closed container 50 and thereafter grounded. Further, the common high voltage terminal plate 77 is usually led out from the closed container 50 and connected another device (not shown) in the gas insulated switch gear device.

Figure 5:
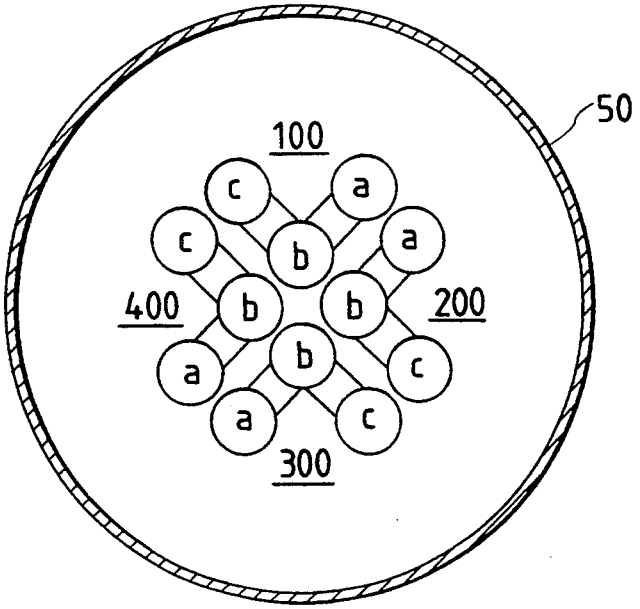
FIG. 5 is a horizontal cross sectional view of another embodiment of the zinc oxide type arresters according to the present invention.

When the respective constitutional units 100, 200, 300 and 400 are constituted as explained above, the facing columnar stack bodies in the adjoining constitutional units show an identical constitution as illustrated in FIG. 1, thereby the potentials of the respective facing columnar stack bodies along their stacking direction are equalized. As a result, the respective constitutional units 100, 200, 300 and 400 can be disposed further closely as illustrated in FIG. 5. Further, in view of variation in voltage-current characteristic caused by the total zinc oxide elements contained in one columnar stack body an insulating distance L is usually provided between the facing columnar stack bodies for the adjoining constitutional units, however even with the provision of the insulation distance L the facing columnar stack bodies can be arranged much closer than those of the conventional arrangement. Moreover, the only four columnar stack bodies b are arranged around an imaginary circle surrounding the center of the closed container 50 and two of the columnar stack bodies in the adjoining constitutional units are arranged to face more closely, the useless space formed at the center portion of the closed container 50 is reduced, accordingly, the diameter of the closed container 50 is reduced. Further, when a closed container 50 having the same diameter as that of the conventional one is used, the distance between the inner wall of the closed container 50 and the respective zinc oxide elements can be increased, thereby a stray capacitance formed therebetween is reduced. As a result, division voltages applied to the respective zinc oxide elements 2 are uniformalized, and further the lifetime and stability after overvoltage suppression of the respective zinc oxide elements 2 are improved.

Figure 6:
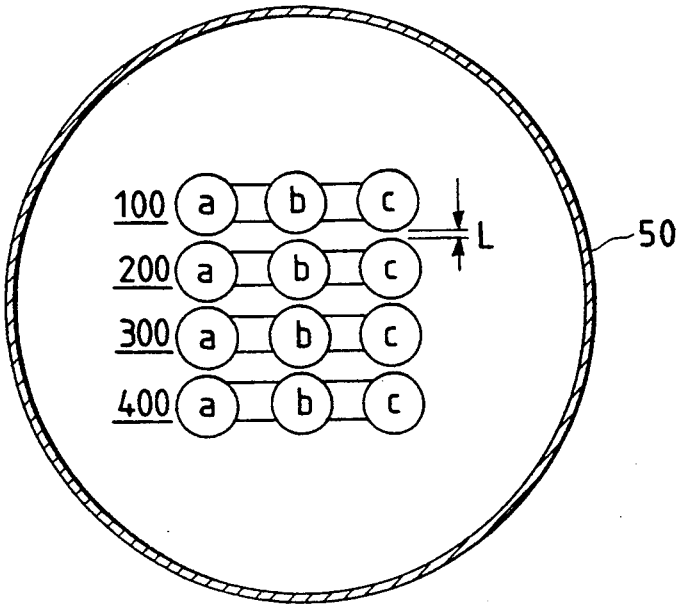
FIG. 6 is a horizontal cross sectional view of a further embodiment of the zinc oxide type arresters according to the present invention.

FIG. 6 is a horizontal cross sectional view of a further embodiment of the zinc oxide type arresters according to the present invention.

The present embodiment is similar to the previous embodiments with regard to a point that the zinc oxide type arrester is constituted by four sets of constitutional units each of which includes three columnar stack bodies a, b and c, however arrangement of the respective columnar stack bodies a, b and c in the respective constitutional units as well as arrangement of the respective constitutional units 100, 200, 300 and 400 are different from those in the previous embodiments. Namely, in the present embodiment, the columnar stack bodies a, b and c in the respective constitutional units are aligned substantially linearly and connected via bridge conductors each other as explained in connection with FIG. 3, and further the respective constitutional units 100, 200, 300 and 400 are respectively aligned on four straight lines which are parallel with a straight line passing through the center of the closed container 50.

All of the columnar stack bodies in the respective constitutional units are arranged in an order of a, b and c, therefore all of the three columnar stack bodies in one constitutional unit face the respective three columnar stack bodies in an adjoining constitutional unit having an identical constitution. Accordingly, potentials of the respective facing columnar stack bodies along their stacking direction are substantially the same, such that the respective constitutional units 100, 200, 300 and 400 can be disposed closely each other with a reduced insulating distance L. In such arrangement, the columnar stack bodies can be disposed in the center portion of the closed container 50 and the space within the closed container 50 is effectively utilized to thereby reduce the diameter thereof. Further, when a closed container 50 having the same diameter as that of the conventional one is used, the distance between the inner wall of the closed container 50 and the respective zinc oxide elements can be increased, thereby a stray capacitance formed therebetween is reduced. As a result, division voltages applied to the respective zinc oxide elements 2 are uniformalized, and further the lifetime and stability after overvoltage suppression of the respective zinc oxide elements 2 are improved.

Figure 7:
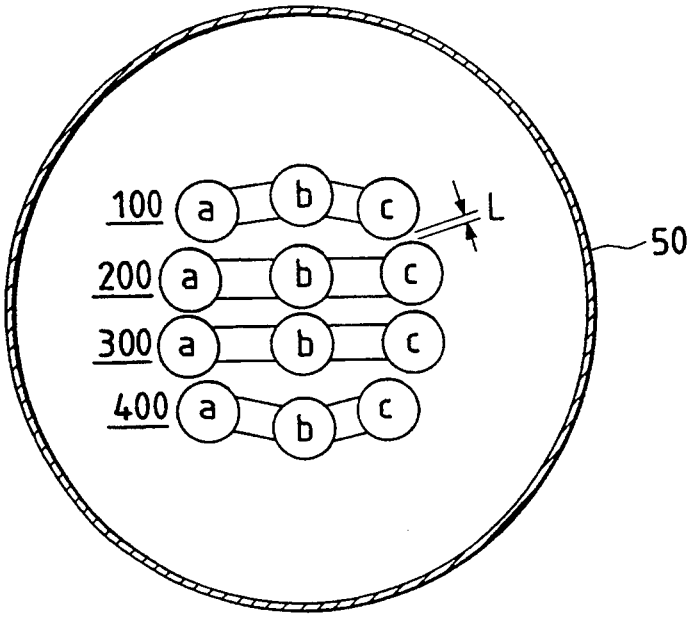
FIG. 7 is a horizontal cross sectional view of a still further embodiment of the zinc oxide type arresters according to the present invention.
Figure 8:
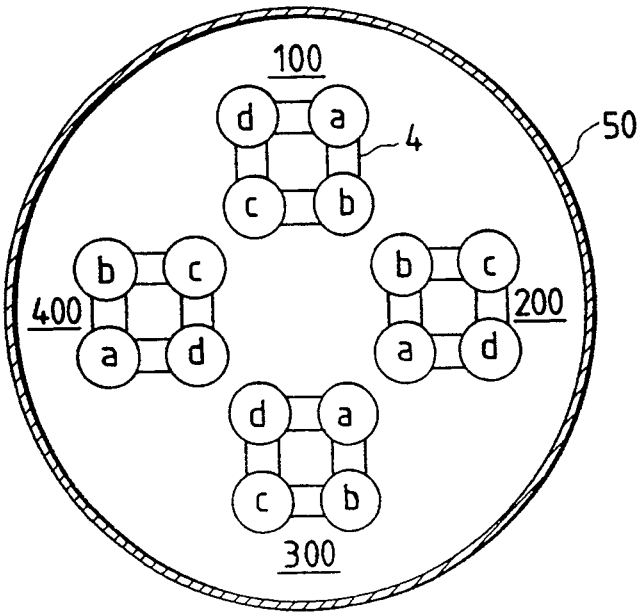
FIG. 8 PRIOR ART
FIG. 8 is a horizontal cross sectional view of a conventional zinc oxide type arrester.

FIG. 7 is a horizontal sectional view of a still further embodiment of the zinc oxide type arrester according to the present invention.

In the previous embodiment shown in FIG. 6, the respective columnar stack bodies a, b and c in all of the constitutional units 100, 200, 300 and 400 are aligned on the respective straight lines, however in the present embodiment, in view of insulation between the respective columnar stack bodies and the closed container 50 the columnar stack bodies a and c in the constitutional units 100 and 400 which are located at outer ends are arranged closer to their respective columnar stack bodies b and further these columnar stack bodies in the constitutional units 100 and 400 are some what shifted away from the facing columnar stack bodies b in the adjoining constitutional units 200 and 300, thereby the respective columnar stack bodies a, b and c facing to the inner wall of the closed container 50 are adapted to be positioned substantially on a concentric circle with that of the closed container 50.

In the present embodiment, the columnar stack bodies in the respective constitutional units 100, 200, 300 and 400 are also aligned in an order of a, b and c, therefore all of the facing columnar stack bodies in adjoining constitutional units have identical constitution and potentials thereof along their height direction are substantially the same, accordingly the respective constitutional units 100, 200, 300 and 400 can be arranged closely while reducing an insulation distance L between the respective constitutional units, and further an insulation between the respective columnar stack bodies and the closed container 50 is desirably maintained, thereby the diameter of the closed container 50 is further reduced.

In the above embodiments, zinc oxide type arresters which are composed of four sets of constitutional units 100, 200, 300 and 400, and each including three columnar stack bodies a, b and c are shown, however the number of the constitutional units and the columnar stack bodies contained therein are not limited to those of the embodiments if a plurality of columnar stack bodies in adjoining constitutional units are arranged to face each other. Further, the electrical connection of the columnar stack bodies contained in one constitutional unit is not limited to that shown in connection with FIG. 2 and FIG. 3 if constitution of a plurality of facing columnar stack bodies contained in adjoining constitutional units as well as potentials thereof along their stacking direction are kept substantially the same. Still further the present invention is not limited to the zinc oxide type arrester having the constitution as shown in FIG. 4 but is applicable to such as a linear resistor block and a capacitor block.

According to the present invention as has been explained above, a plurality of constitutional units each including a plurality of columnar stack bodies are disposed within a closed container, and a plurality of columnar stack bodies in adjoining constitutional units are arranged to face each other and potentials of these facing columnar stack bodies along their stacking direction are adapted to be equalized, thus these facing columnar stack bodies can be arranged closely, thereby the diameter of the closed container is reduced.

We claim:

1. A zinc oxide type arrester comprising:

a closed container which is filled with an insulating medium; and a plurality of constitutional units disposed within said closed container, each of said constitutional units includes a plurality of columnar stack bodies, each of said columnar stack bodies is composed by stacking zinc oxide elements and insulating spacers in a predetermined order, and said zinc oxide elements in a plurality of said columnar stack bodies contained in one constitutional unit are connected in series as adjoining constitutional units among said constitutional units are arranged to face each other and the respective facing columnar stack bodies are constituted so as to have substantially equal potentials along the stacking direction thereof.

2. A zinc oxide type arrester according to claim 1, wherein one of said columnar stack bodies contained in said respective constitutional units are arranged to locate around an imaginary circle surrounding the center of the closed container as .well as a plurality of said columnar stack bodies in adjoining constitutional units among said constitutional units are arranged to closely face each other.

3. A zinc oxide type arrester according to claim 1, wherein each of said constitutional units includes a first columnar stack body composed by stacking said zinc oxide elements and said insulating spacers in a first predetermined order, a second columnar stack body composed by stacking said zinc oxide elements and said insulating spacers in a second predetermined order and a third columnar stack body composed by stacking said zinc oxide elements and said insulating spacers in a third predetermined order, one of said three columnar stack bodies in said respective constitutional units are arranged to locate around a circle surrounding the center of said closed container and further two of said three columnar stack bodies in adjoining constitutional units are arranged to closely face each other.

4. A zinc oxide type arrester according to claim 1, wherein the respective facing columnar stack bodies in adjoining constitutional units have a same stacking structure of said zinc oxide elements and said insulating spacers.

5. A zinc oxide type arrester according to claim 1, wherein each of said constitutional units includes a first columnar stack body composed by stacking said zinc oxide elements and said insulating spacers in a first predetermined order, a second columnar stack body composed by stacking said zinc oxide elements and said insulating spacers in a second predetermined order and a third columnar stack body composed by stacking said zinc oxide elements and said insulating spacers in a third predetermined order, and one zinc oxide element in said first columnar stack body and one zinc oxide element in said third columnar stack body contained in one constitutional unit are connected alternatively to one zinc oxide element in said second columnar stack body contained in the same constitutional unit.

6. A zinc oxide type arrester according to claim 1, wherein said respective columnar stack bodies contained in said respective constitutional units are aligned linearly, said respective constitutional units are aligned in parallel each other and the respective facing columnar stack bodies in adjoining constitutional units are constituted to show substantially the equal potentials along their stacking direction.

7. A zinc oxide type arrester according to claim 6, wherein said columnar stack bodies in said respective constitutional units locating to face an inner wall of said closed container are arranged substantially around a concentric circle with that of said closed container.

8. A zinc oxide type arrestor comprising:

four constitutional units electrically connected in parallel; and a closed container accommodating said four constitutional units, each of said constitutional units includes a first columnar stack body composed by stacking zinc oxide elements and insulating spacers in a first predetermined order, a second columnar stack body composed by stacking zinc oxide elements and insulating spacers in a second predetermined order and a third columnar stack body composed by stacking zinc oxide elements and insulating spacers in a third predetermined order, said zinc oxide elements in said first, second and third columnar stack bodies contained in one constitutional unit are connected in series as a whole, and at least two of the three columnar stack bodies having same stacking structures in adjoining constitutional units are arranged to face each other.

* * * * *